United States Patent [19]

Krol et al.

[11] 4,120,080

[45] Oct. 17, 1978

[54] METHOD OF MANUFACTURING GRID ELECTRODES FOR ELECTRON TUBES

[75] Inventors: Johannes Wilhelmus Antonius Krol, Eindhoven, Netherlands; Bernhard Lersmacher, Aachen; Horst Seifert, Hamburg, both of Fed. Rep. of Germany

[73] Assignee: U.S. Philips Corporation, New York, N.Y.

[21] Appl. No.: 776,254

[22] Filed: Mar. 10, 1977

[30] Foreign Application Priority Data

Mar. 27, 1976 [DE] Fed. Rep. of Germany ..... 2613170

[51] Int. Cl.[2] ..... H01J 9/14

[52] U.S. Cl. ..... 29/25.18; 427/122

[58] Field of Search ..... 29/25.17, 25.18; 427/249, 228, 122

[56] References Cited

U.S. PATENT DOCUMENTS

| | | | |
|---|---|---|---|
| 2,693,431 | 11/1954 | Williams | 427/228 X |
| 2,911,319 | 11/1959 | Peter | 427/228 X |
| 3,535,758 | 10/1970 | Hoet | 51/312 X |

OTHER PUBLICATIONS

R and D on Advanced Graphite Materials, by P. H. Higgs et al., 1964, pp. 1-42, Air Force Tech. Rept. WADD TR 61-72, vol. 37.

*Primary Examiner*—Richard B. Lazarus
*Attorney, Agent, or Firm*—Frank R. Trifari; Algy Tamoshunas

[57] ABSTRACT

Disclosed is a method of manufacturing a pyrolytic graphite grid electrode in which after formation of the grid, the electrode is annealed at a temperature of 700° to 1200° C in a reactive atmosphere to remove carbon particles adhering to the electrode surface.

10 Claims, 1 Drawing Figure

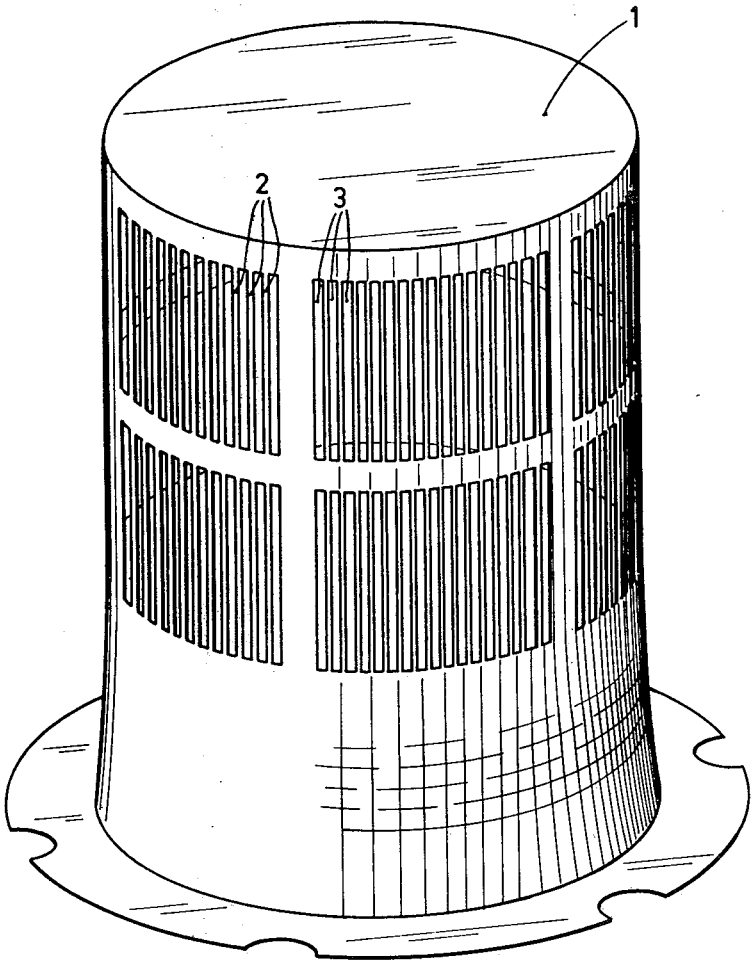
1
2
3

METHOD OF MANUFACTURING GRID ELECTRODES FOR ELECTRON TUBES

The invention relates to a method of manufacturing grid electrodes for electron tubes, in which pyrolytic graphite is deposited on a mandril by the thermal decomposition of carbonaceous gases and the moulded body thus formed is separated from the mandril and provided with grid-like apertures.

The invention also relates to grid electrodes manufactured according to the method.

Such grids are used in transmitter tubes, rectifier tubes, and the like.

Such a method is known from German patent application No. P 2,450,261.2 in which measures are proposed to improve the quality of the carbon grids manufactered in this manner. These measures preferably produce a decrease of the grid emission as well as an improvement of the high voltage resistance by avoiding sharp points and adhering particles on the electrode surface. Briefly, the already proposed measures are as follows:

1. The use of very smooth (polished) substrates (mandrils) for cutting the non-finished grids (for example a polished substrate of glassy carbon).

2. The subsequent coating of the finished electrodes, so the enveloping and coating with a thin impervious layer of pyrolytic graphite.

3. Thermal after-treatment of the finished electrodes at very high temperatures (~3000° C.) for recrystallizing and evaporating adhering particles.

It has been found that the measures 1 to 3 are not always sufficient to obtain good electrode surfaces, namely surfaces which are free from sharp points and adhering particles. Such adhering carbon particles can have a particularly unfavourable influence on the grid emission and, in addition, they result in a low high-voltage resistance. Such particles for example, can be formed during the cutting of the grid structures by means of laser beams by condensation of carbon which forms an adhering granular coating on or near the cutting faces. Of course, carbon particles or other particles also crystallize in cutting methods other than ones using laser beams.

It is the object of the invention to provide electrode surfaces free from carbon particles and hence to obtain better grid emission and high voltage resistance properties of the electrode grids.

According to the invention in a method of the kind mentioned in the preamble, the moulded body after the formation of the grid is subjected to an annealing treatment at 700° to 1200° C. in a reactive atmosphere.

The reactive atmosphere may, for example, be air, oxygen-nitrogen mixtures or pure oxygen at reduced pressure. The annealing treatment is preferably carried out in an oxygen-containing atmosphere, for example, air. A preferred temperature range is 950° to 1050° C. The duration of the annealing treatment is preferably less than 3 minutes.

According to a further embodiment of the method according to the invention, the moulded body is cleaned in an ultrasonic bath prior to the annealing treatment. It may furthermore be efficacious to cover the moulded body after the annealing treatment with a thin layer of pyrolytic graphite. In the case of irregularly shaped electrodes, heating by high-frequency induction is preferably used during the annealing treatment.

Summarizing, the method according to the invention consists of the following steps:

(a) After the shaping treatment of the unfinished electrodes of pyrolytic graphite, that is after cutting the grid apertures by means of a laser beam, ion beam or electron beam, spark erosion, mechanical treatment or electro-chemical methods — the electrode is cleaned mechanically, if desired, in an ultrasonic bath. During this treatment, adhering particles in particular ones having a low adhesion are removed.

(b) The electrode is then subjected to an annealing treatment in a reactive atmosphere, preferably an oxygen-containing atmosphere, in particular, air.

(c) If desired, the electrode is finally coated with a thin layer of pyrolytic graphite.

The invention will now be described in greater detail with reference to a drawing showing a grid for an ultra high-frequency tube manufactured according to the method of the invention.

A pyrolytic graphite grid 1 cut by means of a laser and having a diameter of approximately 15 mm, a height of approximately 50 mm, a wall thickness of approximately 200 μm, a width of the grid rods 2 of 200 μm and grid apertures 3 of approximately 100 μm was heated in air in an induction coil having a high frequency of approximately 1 MHz for approximately 30 seconds at a temperature of 1050° C. and maintained at this temperature for 1 minute. After cooling (in approximately 10 to 20 seconds) the surface had a shining-metallic appearance while prior to the treatment it was dull black. Grid electron microscopic photographs show that previously adhering carbon condensate has been etched away quantitatively. Upon using the method it is advantageous that in pyrolytic graphite, as a result of the very good thermal conductivity, a complete temperature equilibrium is substantially spontaneously formed parallel to the surface.

What is claimed is:

1. A method of manufacturing grid electrodes for electron tubes comprising the steps of depositing pyrolytic graphite by thermal decomposition of a carbonaceous gas on a mandril thereby to form a moulded body, separating the moulded body thus formed from the mandril, providing said body with grid-like apertures, and annealing said body at a temperature of 700° to 1200° C. for less than three minutes in an oxygen containing atmosphere.

2. A method according to claim 1, wherein said body is annealed at a temperature between 950° to 1050° C.

3. A method according claim 1, including cleaning said body in an ultrasonic bath prior to annealing.

4. A method according to claim 1, including coating said body with a thin layer of pyrolytic graphite after said body is annealed.

5. A method of manufacturing grid electrodes for electron tubes comprising the steps of depositing pyrolytic graphite by thermal decomposition of a carbonaceous gas on a mandril thereby to form a moulded body, separating the moulded body thus formed from the mandril, providing said body with grid-like apertures, annealing said body at a temperature of 700° to 1200° C. and then coating the moulded body with a thin layer of pyrolytic graphite.

6. A method according to claim 5, wherein said body is annealed in an oxygen-containing atmosphere.

7. A method according to claim 5, wherein said body is annealed for less than three minutes.

8. A method according to claim 5, wherein the step of annealing is carried out by high-frequency induction heating.

9. A method according to claim 5, including cleaning said body in an ultrasonic bath prior to annealing.

10. A method of manufacturing grid electrodes for electron tubes comprising the steps of depositing pyrolytic graphite on a mandril by thermal decomposition of a carbonaceous gas thereby to form a moulded body, separating the moulded body thus formed from the mandril, providing said body with grid-like apertures, and subsequently annealing said body at a temperature of 700° to 1200° C. in a reactive atmosphere for a sufficient time to remove carbon particles adhering to the surface of said body.

* * * * *